US007249819B2

(12) United States Patent
Burdette et al.

(10) Patent No.: US 7,249,819 B2
(45) Date of Patent: Jul. 31, 2007

(54) APPARATUS AND METHODS OF DETECTING RELATIVE POSITION OF RF SIGNATURE ON PRINT MEDIA

(75) Inventors: Chris Anthony Burdette, Richmond, KY (US); Keith Bryan Hardin, Lexington, KY (US); Mark Stephen Underwood, Lexington, KY (US); Terry Lee Wells, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 340 days.

(21) Appl. No.: 10/939,634

(22) Filed: Sep. 13, 2004

(65) Prior Publication Data

US 2006/0055721 A1 Mar. 16, 2006

(51) Int. Cl.
*B41J 29/393* (2006.01)

(52) U.S. Cl. ..... 347/19

(58) Field of Classification Search ..... 347/19; 340/572.1

See application file for complete search history.

(56) References Cited

U.S. PATENT DOCUMENTS 6,246,326 B1 6/2001 Wiklof et al.
6,593,853 B1 7/2003 Barrett et al.
6,747,560 B2 6/2004 Stevens, III
6,750,769 B1 6/2004 Smith
7,038,573 B2 * 5/2006 Bann ..... 340/10.1
7,056,048 B2 * 6/2006 Braun et al. ..... 400/630
2006/0017568 A1 * 1/2006 Burdette et al. ..... 340/572.1

* cited by examiner

*Primary Examiner*—Stephen Meier
*Assistant Examiner*—Jason Uhlenhake
(74) *Attorney, Agent, or Firm*—Grossman, Tucker, Perreault & Pfleger, PLLC

(57) ABSTRACT

The presence of a radio frequency signature (88) on a cut sheet of print media (28) is detected by a radio frequency interrogating device (94) to determine it's relative left/right position on the print media (28). Either the leading edge (124) or trailing edge (126) of the print media (28) is detected by one or more print media sensors (86, 90). A print controller (24) can note the time ($t_1$) when print media is detected and cause the radio frequency interrogating device (94) to detect the radio frequency signature (88) at a time ($t_2$) when the print media has reached a predetermined point along the print media pathway (110). The position of the radio frequency signature (88) on the print media (28) can be calculated using the time differential ($t_2$-$t_1$) and the known angular displacement of the radio frequency interrogating device (94).

20 Claims, 5 Drawing Sheets

APPARATUS AND METHODS OF DETECTING RELATIVE POSITION OF RF SIGNATURE ON PRINT MEDIA

CROSS-REFERENCE TO RELATED APPLICATIONS

This application is related to application Ser. No. 10/897,131 filed Jul. 22, 2004, entitled APPARATUS AND METHOD OF DETECTING PRINT MEDIA ORIENTATION by the same inventors.

TECHNICAL FIELD

Specific embodiments of the present invention relate to apparatus and methods of detecting the position of a radio frequency signature on print media and more specifically to detecting relative position or one or more RFID tags on a sheet or print media sheet across the width of the print media as it is fed through a printing device.

BACKGROUND OF THE INVENTION

Inkjet and laser printers have become commonplace equipment in most workplace and home computing environments. Today, many printers are multi-functional assemblies capable of printing on a large array of print media such as, for example, letterhead, envelopes and labels. A recent innovation in the printing industry involves the manufacturing of print media with embedded radio frequency signatures such as is possible with a Radio Frequency Identification (RFID) tag. These tags, sometimes called "Smart Labels", may be used with a variety of existing printing methods and the embedded tags may be programmed with information that is of use to the user.

Such print media generally comprises a backing material (sometimes referred to as the "web") upon which a label is applied, with a RFID tag sandwiched between the label and the backing. There may be one or more labels on the web and the sheet as presented may be part label and part plain paper. Typically, there is a desired orientation of the media to be fed through the printer that will ensure the printed image aligns as intended with the labels and/or tags on the media sheet.

In some cases, there may be more than one tag arrayed across the width of the media. In other cases, the position of a tag across the width of the media may be used to indicate when the media is mis-fed, and therefore allow the user to take some form of corrective action. For these reasons and others, it is desirable for the printing device to be able to determine the relative location of each tag on the media sheet in the horizontal direction.

BRIEF DESCRIPTIONS OF THE DRAWINGS

Figure 1:
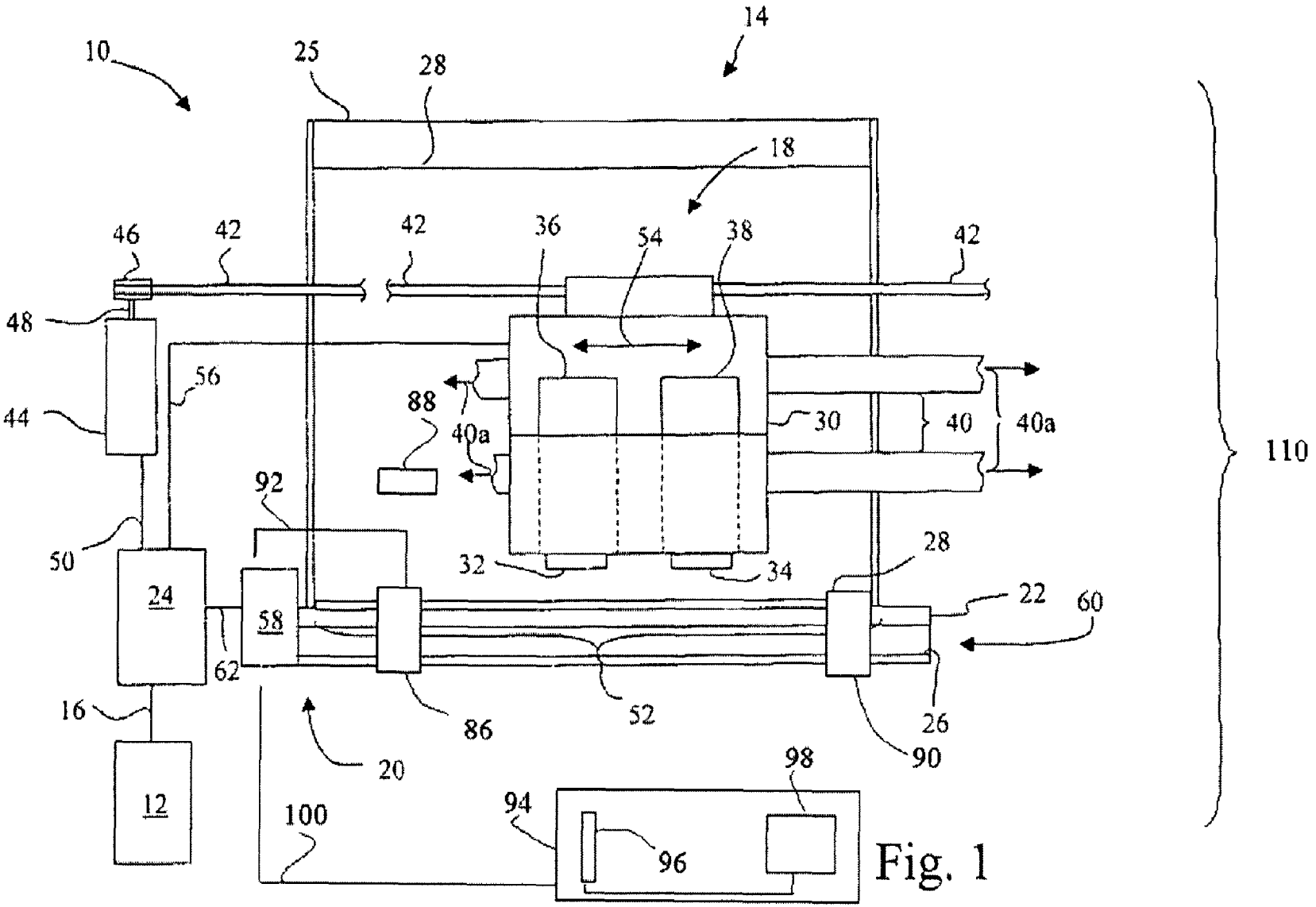
Figure 2A:
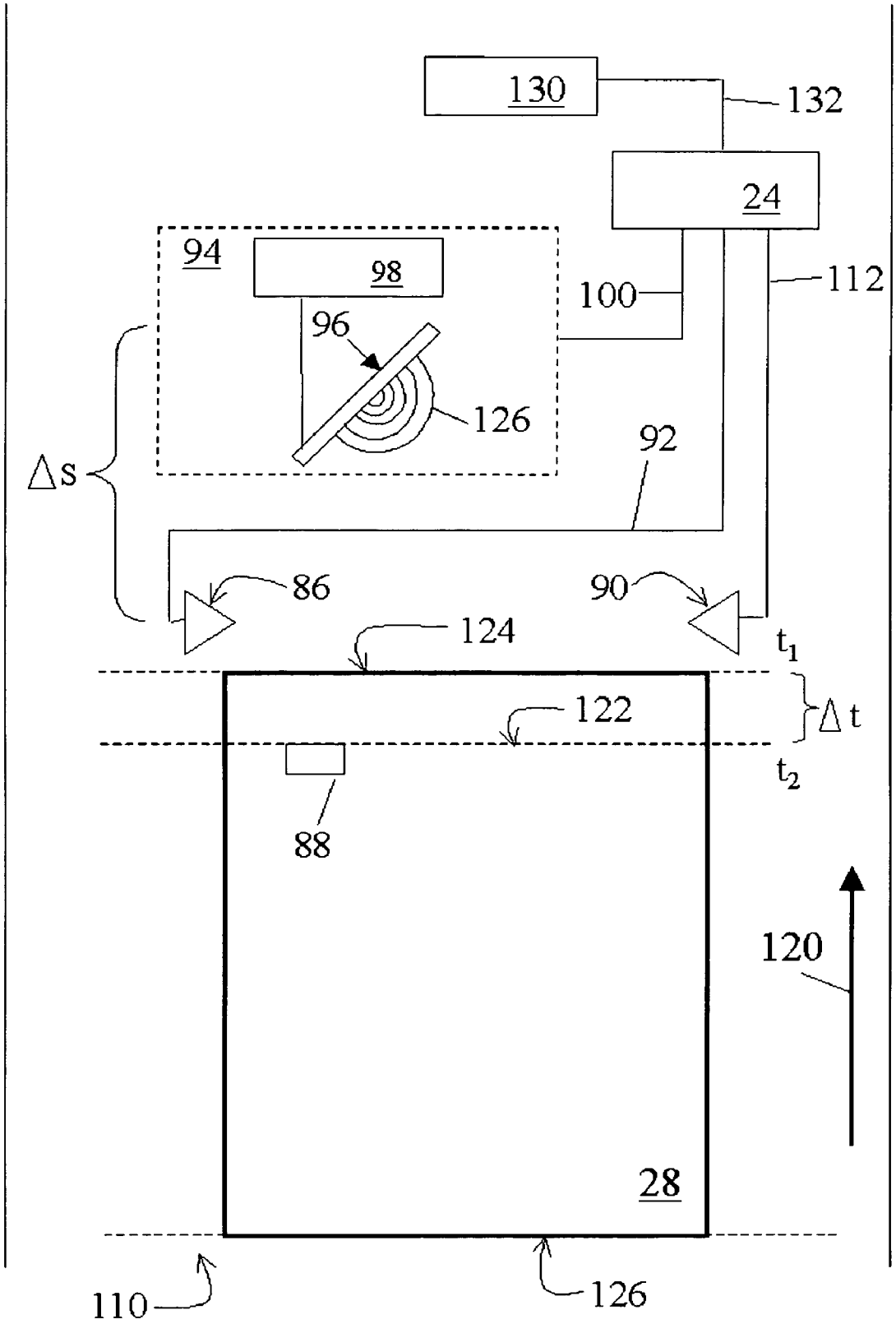
Figure 2B:
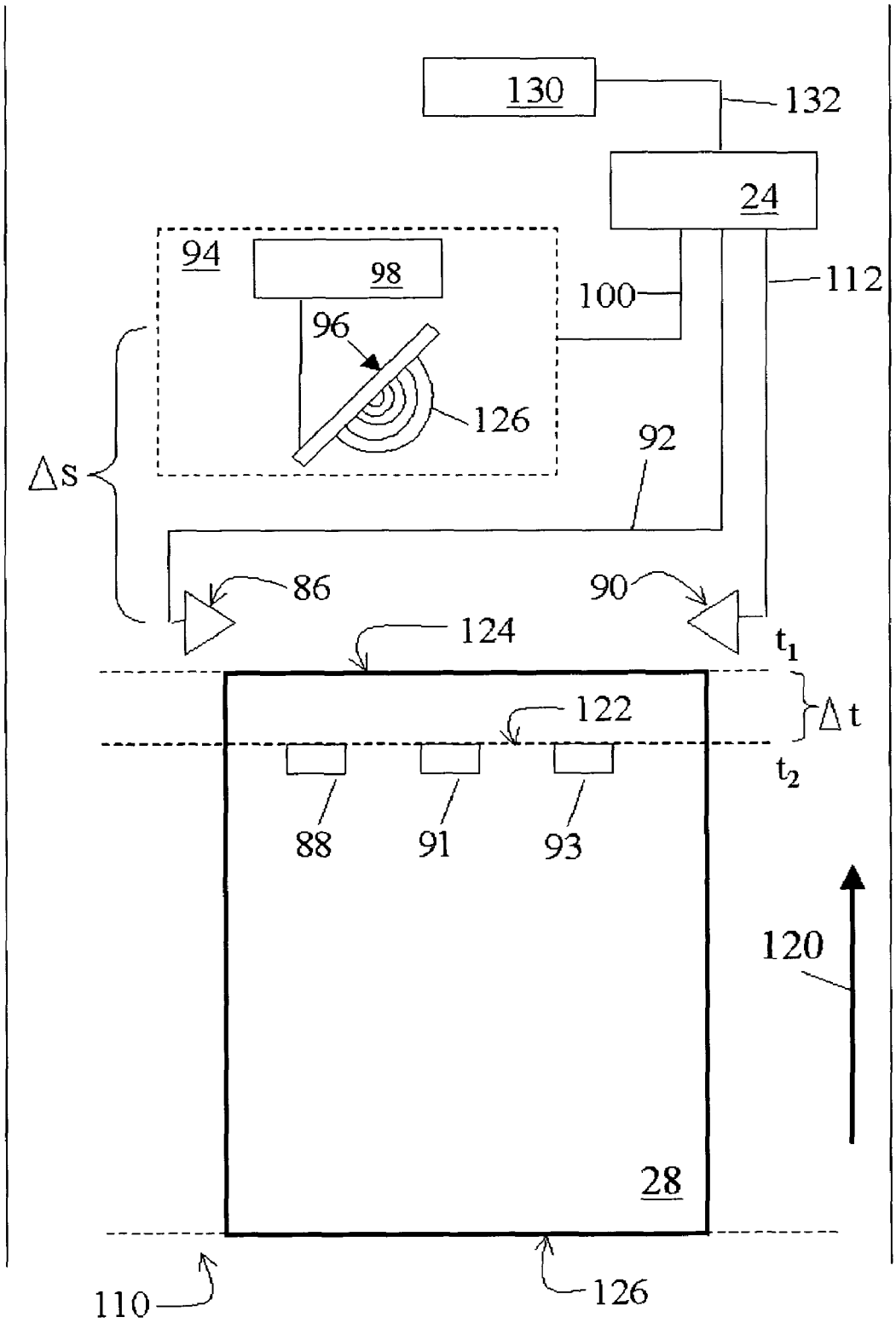
Figure 3:
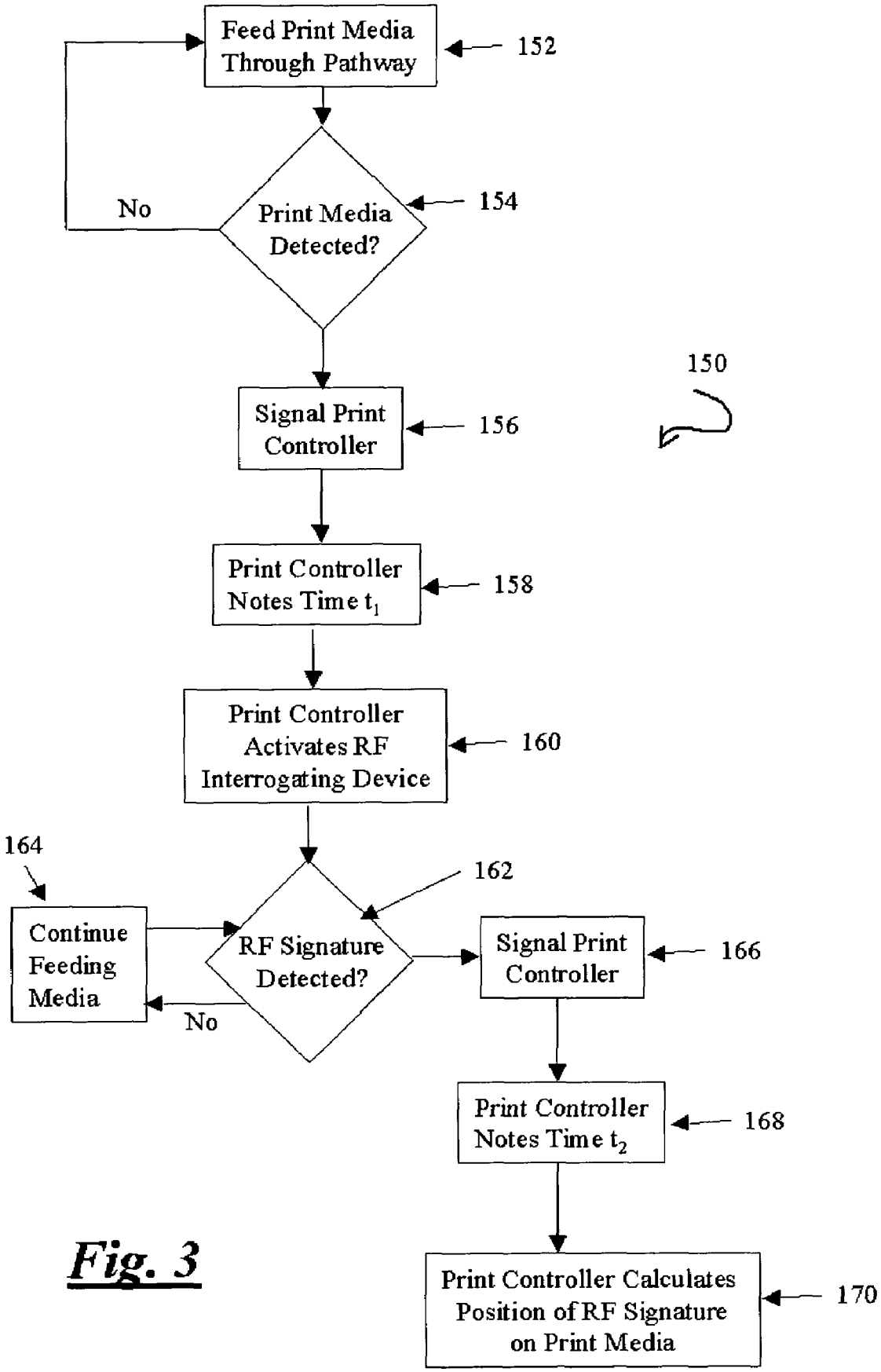
Figure 4:
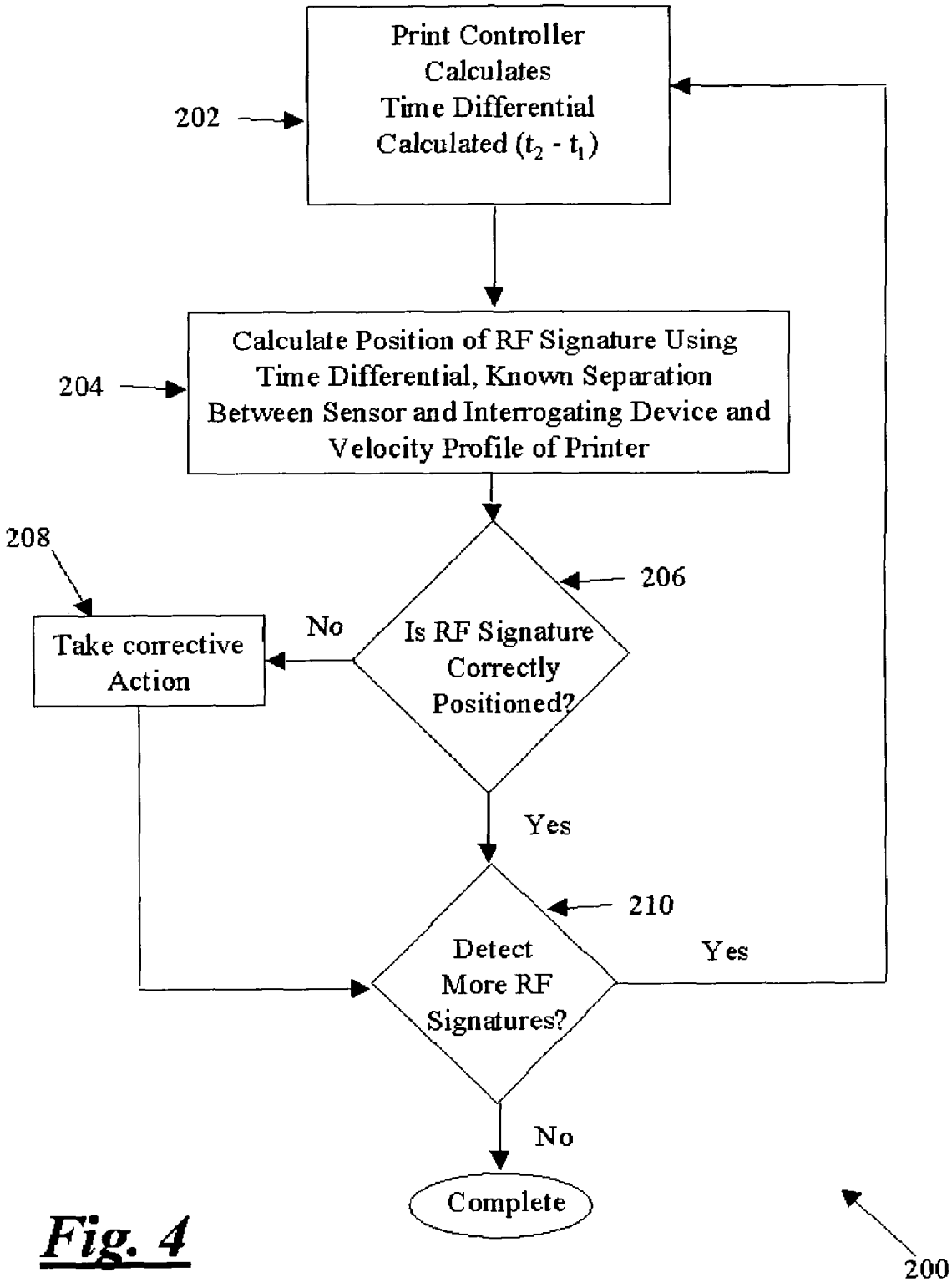

The present invention is illustrated by way of example and not limitation in the figures of the accompanying drawings in which like references indicate similar elements, and in which:

FIG. 1 is a diagrammatic representation of a print media orientation detecting apparatus according to one embodiment of the invention;

FIGS. 2*a* and 2*b* show print media embedded with one or more radio frequency signature(s);

FIG. 3 is a process flow diagram for a method of detecting the position of radio frequency signatures according to the invention; and FIG. 4 is a process flow diagram for a method of calculating the position of a radio frequency signature on printed media according to the invention.

DETAILED DESCRIPTION

Referring now to the drawings and more particularly to FIG. 1, therein are shown the various electro-mechanical systems for a radio frequency signature position detecting apparatus 10 according to one embodiment of the present invention. Apparatus 10 may include a host 12 and a printer assembly 14 such as, for example, an ink jet or laser printer or other image forming platform. For convenience, apparatus 10 will be described in connection with an ink jet printer although it should be understood the radio frequency signature position detecting apparatus 10 of the invention may be implemented in other image forming platforms such as laser or dye diffusion, for example.

Host 12 is communicatively coupled to printer assembly 14 by way of communications link 16. Communications link 16 may be established by, for example, a direct connection, such as a cable connection, between printer assembly 14 and host 12; by a wireless connection; or by a network connection, such as for example, an Ethernet local area network (LAN) or a wireless networking standard, such as IEEE 802.11. Host 12 may include a display, an input device such as a keyboard, a processor and associated memory. Resident in the memory of host 12 may be printer driver software which places print data and print commands in a format that can be recognized by printer assembly 14. The format can be, for example, a data packet including print data and printing commands for a given print request and may include a print header that identifies the scan data. The printer driver software may also include print media information such as, for example, media type and size. In addition, such print media information may include the expected and predetermined placement of radio frequency signature, such as a RFID tag which has been placed on or embedded in the print media as a "Smart" Label or other similar cut-sheet print media, as well as the expected separation between an edge of the print media and the radio frequency signature. By providing the placement information for the radio frequency signature, it is possible to compare the actual placement of the signature on a particular sheet of print media to the expected location.

FIG. 1 shows that printer assembly 14 includes a printhead carrier system 18, a print media feed system 20, a mid-frame 22, a print controller 24, a print media source 25 and an exit tray 26. Print media source 25 is configured and arranged to supply individual sheets of print media 28 to print media feed system 20 which, in turn, further transports sheets of print media 28 during a printing operation.

Printhead carrier system 18 includes a printhead carrier 30 which may carry, for example, a color printhead 32 and black printhead 34. A color ink reservoir 36 is provided in fluid communication with color printhead 32 and a black ink reservoir 38 is provided in fluid communication with black printhead 34. Reservoirs 36, 38 may be located near respective printheads 32 and 34, which in turn may be assembled as respective unitary cartridges. Alternatively, reservoirs 36, 38 may be located remote from printheads 32, 34, e.g., off-carrier, and reservoirs 36, 38 may be fluidly interconnected to printheads 32, 34, respectively, by fluid conduits. Printhead carrier system 18 and printheads 32 and 34 may be configured for unidirectional printing or bi-directional printing.

Printhead carrier 30 is guided by a pair of guide rods 40. Alternatively, one of guide rods 40 could be a guide rail made of a flat material, such as metal. The axes 40*a* of guide rods 40 define a bi-directional-scanning path, also referred to as 40*a*, of printhead carrier 30. Printhead carrier 30 is connected to a carrier transport belt 42 that is driven by a carrier motor 44 by way of a driven carrier pulley 46. Carrier motor 44 has a rotating carrier motor shaft 48 that is attached to carrier pulley 46. Carrier motor 44 is electrically connected to print controller 24 via communications link 50. At a directive of print controller 24, printhead carrier 30 is transported, in a reciprocating manner, along guide rods 40. Carrier motor 44 can be, for example, a direct current motor or a stepper motor.

The reciprocation of printhead carrier 30 transports ink jet printheads 32 and 34 across the sheet of print media 28 along bi-directional scanning path 40*a* to define a print area 52 of printer assembly 14 as a rectangular region. This reciprocation occurs in a scan direction 54 that is parallel with bi-directional scanning path 40*a* and is also commonly referred to as the horizontal scanning direction. Printheads 32 and 34 are electrically connected to print controller 24 via communications link 56.

During each printing pass, i.e., scan, of printhead carrier 30, while ejecting ink from printheads 32 and/or 34, the sheet of print media 28 is held stationary by print media feed system 20. Before ink ejection begins for a subsequent pass, print media feed system 20 conveys the sheet of print media 28 in an incremental, i.e., indexed, fashion to advance the sheet of print media 28 into print area 52. Following printing, the printed sheet of print media 28 is delivered to print media exit tray 26. Print media feed system 20 includes a drive unit 58 coupled to a sheet handling unit 60. Drive unit 58 is electrically connected to print controller 24 via communications link 62, and provides a rotational force which is supplied to sheet handling unit 60.

As such, printer assembly 14 provides a print media pathway 110 for the transport of print media 28 from a paper source 25 to a designated print area 52. Printer assembly 14 includes a print media sensor 86 capable of detecting when print media 28 has reached a predetermined point along the print media pathway 110. Print media sensor 86 may be configured to detect the leading edge of the print media 28 as it is conveyed by the print media feed system 20 through the printer assembly 14. In addition to or alternatively, the print media sensor 86 may detect the trailing edge of the print media 28. In this regard, the leading edge of the print media 28 is defined as the media edge which enters the printing device's print area 52 first and the trailing edge is equivalently to that edge which enters the print area 52 last.

The invention has particular application and provides particular advantages in the context of modern day printers, such as print assembly 14 and other types of printer platforms, that employ one or more sensors arranged about a printer's print media pathway to determine and track the location of print media as it passes through the printer's print area, such as print area 52. Such sensors may be arranged to "make" at the leading edge of a sheet of print media and "break" at the trailing edge, providing a print controller, such as print controller 24, with an indication of the location of the print media at any given point along the printer's print media pathway 110. For this purpose, printer assembly 14 may include a second print media sensor 90 which functions like first print media sensor 86. In either configuration, i.e. one or two print media sensors, a communications link 92 is provided between the print media sensor 86 and the print controller 24. Communications link 92 provides a means for print media sensor 86 to signal print controller 24 and thereby notify print controller 24 that a sheet of print media, such as print media 28, has been detected. A similar communications link (not shown) may be provided coupling the second print media sensor 90 to the print controller 24. In this way, the print controller 24 will know when the leading edge and/or trailing edge of the print media 28 traverses the print area 52 and/or a predetermined point along the print media pathway 110.

As shown, a radio frequency signature 88 has been placed on or embedded in print media 28 at a specific location. Radio frequency signature 88 may be detected by a suitable radio frequency detection device. In one embodiment, radio frequency signature 88 takes the form of a Radio Frequency Identification (RFID) tag that is placed on print media 28 prior to being loaded into print media source 25 such as during manufacture, i.e. at a paper plant or specialty paper mill. A radio frequency interrogating device 94 is placed about the printer assembly 14 in an area where it can detect the presence of radio frequency signature 88 once print media 28 has reached a predetermined point along the print media pathway 110.

By placing radio frequency signature 88 at a predetermined and known location on the print media 28, radio frequency interrogating device 94 can be used to detect radio frequency signature 88. Once radio frequency signature 88 is detected, a signal is communicated to print controller 24 to indicate the presence of radio frequency signature 88 on print media 28. Print controller 24 can then calculate the position of radio frequency signature 88 and determine if it is properly placed on print media 28 as expected and, if not, cause print assembly 14 to take corrective action such as suspending print operations, sending a warning message to a user and/or canceling pending print requests, among other options.

As such, print controller 24 of print assembly 14 may confirm if a radio frequency signature 88 embedded in print media 28 is positioned as expected on print media 28. It is contemplated that any one of a plurality of commercially available RFID readers can be used as radio frequency interrogating device 94. Therefore, radio frequency interrogating device 94 may be equipped with a RFID antenna 96 and a RFID read/write module 98. RFID antenna 96 is used to communicate with and/or detect radio frequency signals from, for example, a standard RF emitting device, such as a RFID tag comprising radio frequency signature 88 on print media 28. RFID read/write module 98 includes the interface and process logic for communication with an RFID tag as well as with an external host system, such as host 12. Communications link 100 coupling radio frequency interrogating device 94 to print controller 24 provides a signal pathway for this purpose. Radio frequency signature 88 may also include information about the print media 28 such as the size, weight, brightness, location of radio frequency signature and/or other characteristics of the print media. Alternatively, radio frequency signature 88 may include no readable information at all but its position on print media 28 is known allowing print controller 24 to determine if print media 28 is properly oriented.

Apparatus 10 provides a means of coupling the information provided by the paper path sensors 86, 90 to information provided by a radio frequency based system, such as a RFID system, consisting of radio frequency signature 88 (or RFID tag) and radio frequency interrogating device 94 (or RFID reader). In this way, print controller 24 may calculate the orientation of a cut sheet of print media 28 as it passes through the print area 52. While it is contemplated that a RFID system including a RFID reader, RFID antenna and RFID tag could be used for such a purpose, other suitable RF-based components may also be employed.

With reference to FIGS. 2*a* and 2*b*, the print media pathway 110 is shown extending in the direction of arrow 120 so that the leading edge 124 of print media 28 traverses print media sensors 86, 90 as print media 28 is fed along print media pathway 110. Once leading edge 124 is detected by sensor 86, sensor 90 and/or both, a signal may be communicated to print controller 24 along communication link 92 and/or communication link 112, respectively, thereby informing print controller 24 that print media 28 has reached a designated point along the print media pathway 110. Also, once leading edge 124 is detected by print media sensor 86 and/or 90, radio frequency interrogating device 94 may begin interrogating radio frequency signature 88 in order to detect its presence.

Print controller 24 may access print driver 130 to obtain information about the print media 28 such as, for example, the expected horizontal position of the radio frequency signature 88 on print media. Print controller 24 may note the time ($t_1$) when the leading edge 124 of print media 24 first is detected by either sensor 86 and/or sensor 90. Next, print controller 24 may note the time ($t_2$) when radio frequency signature 88 is detected by radio frequency interrogating device 94. By subtracting one time from the other ($t_1-t_2$), the difference ($\Delta t$) may be calculated to determine a time difference between the time the leading edge 124 of the print media 28 is detected and the time when a radio frequency signature 88 is detected. A similar computation can be made using the trailing edge 126 of print media 28.

As shown, radio frequency interrogating device 94 includes a radio frequency antenna 96 that is angularly positioned with respect to the direction of travel of print media 28 as indicated by arrow 120. By placing radio frequency antenna 96 at an angle with respect to the direction of travel of the print media 28, the time delta ($\Delta t$) between the sensor trigger event ($t_1$) and the tag presence event ($t_2$) will depend upon the position of the radio frequency signature 88 from left to right on the print media 28. If there are multiple radio frequency signatures (as indicated by elements designated as 88, 91 and 93 on FIG. 2*b*) on the print media 28, the apparatus 10 and methods of the present invention may be used to determine the relative left/right position as well as the relative left/right order of each signature detected.

It is desired that radio frequency emitting devices that come within the range, as indicated by circular lines 126, of radio frequency antenna 96 would be detected as the print media 28 is fed through print media pathway 110. Various techniques may be used to ensure the desired sensitivity of the radio frequency antenna 96 such as, for example, shielding the transponder portion (not shown) of the antenna 96 so that it only responds when a radio frequency emitting device, such any one of signatures 88, 91, or 93, are traveling directly below the transponder portion of the radio frequency antenna 96. Other methods of obtaining a desired sensitivity may likewise be used. In this way, the radio frequency antenna 96 will not react to radio frequencies, such as any that may be emitting from stray or unintended signatures, which are left or right from a position signatures such as 88, 91 or 93. This allows the invention to be used with print media that may be embedded with a plurality of radio frequency information in the form, for example, of RFID tags which are not placed on the media for positioning purposes useful to the objects of the present invention.

A variety of factors may be used to calculate the position of a radio frequency signature. One such factor may include the separation ($\Delta S$) between the radio frequency antenna 96 and one of the paper position sensors 86 and/or 90 in the apparatus 10. In addition, the relative geometries of these devices (the antenna and sensors) may be made known to the printer controller 24 to assist in the position calculations.

FIGS. 2*a* and 2*b* show that print driver 130 may be communicably linked to print controller 24 via communications link 132. In this way, print controller 24 may obtain information indicating the expected separation of the leading edge 124 from the detection line 122 of radio frequency signature 88. Once radio frequency signature 88 comes within detectable range of radio frequency interrogating device 94, a signal may be communicated to print controller 24 over communications link 100. Print controller 24 may compute the position of radio frequency signature 88 by using the computed time differential ($\Delta t$) with the velocity of print media 28 along print media pathway 110. By comparing the computed position of the radio frequency signature 88 with the information obtained from print driver 130, the relative horizontal position of radio frequency signature 88 (and 91 and 93 in FIG. 2*b*) on print media 28 may be determined. Thus, outside a specified tolerance, a discrepancy between the computed position of the radio frequency signature 88 and the expected position may be taken as an indication the print media 28 is incorrectly oriented or mis-fed. Should print media 28 be incorrectly oriented, corrective action may be taken such as, for example, suspending print operations and/or sending a warning message to a user and/or canceling pending print requests. In this way, the waste and cost associated with ruined print media due to mis-orientations can be avoided.

Of course, it should be understood that variations to the functionality of radio frequency signature position detecting apparatus 10 may be implemented. For example, instead of detecting the leading edge, the print assembly 14 may be arranged to detect the trailing edge 126 of the print media. Also, print media sensors 86, 90 may be configured to detect both the leading edge 124 and trailing edge 126. Still other variations will be apparent to those of ordinary skill.

In FIG. 3, a process flow diagram for a method of detecting the position of a radio frequency signature is shown and denoted generally as 150. Process 150 begins at step 152 wherein a cut sheet of print media is fed through a print media pathway, such as pathway 110. Step 154 determines if the leading edge (or trailing edge) of the print media is detected with the media being fed through the print media pathway until it is. Once detected, the print controller is notified, step 156, and the print controller notes the time ($t_1$) when the print media is detected, step 158. Depending on the imaging system, the print controller may activate the radio frequency interrogating device, step 160, putting the device in a ready state for detecting a radio frequency signature, such as radio frequency signature 88. In one specific embodiment, this entails a RFID reader interrogating a RFID tag within a detectable range of a radio frequency antenna 96 to determine when the RFID tag has passed through a designated point of the print media pathway 110.

Next, at step 162, it is determined if the radio frequency signature has been detected and, if so, process flow is directed to step 166 wherein the print controller is signaled to indicate the radio frequency signature has passed through a designated point along the print media pathway. If not, the print media continues to be fed along the media pathway, step 164. Once the radio frequency signature is detected, the print controller notes the time ($t_2$) of detection, step 168. Using the time difference ($t_2-t_1$), the known separation between the print controller and one or more print media sensor and the velocity profile of the print media, the position of a radio frequency signature on the print media may be calculated, step 170.

FIG. 4 is a process flow diagram, denoted generally as 200, for a method of calculating the position of a radio frequency signature on print media as it is fed through print media pathway. Process 200 begins at step 202 wherein a print controller, such as print controller 24, calculates the time differential ($t_2-t_1$) between the time the leading edge of print media fed through the printing device is detected and the time when a radio frequency signature on the print media is detected. Of course, a similar computation can be made using the trailing edge of print media. Next, at step 204 the position of the radio frequency signature on the moving print media is determined by considering the time differential along with the known separation between an edge of the print media and the radio frequency signature and the velocity profile of the printer which indicates how fast the print media is traveling through the printer's print media pathway. At step 206, the calculated position of the radio frequency signature is compared with the expected position and a decision is made if the difference, if any, is within a specified tolerance. If so, that may be taken as an indication the print media is correctly oriented. On the other hand, should the difference in positions be outside a specified tolerance then a determination is made that print media is probably improperly oriented or mis-fed, with respect to an image orientation of a print job. As such, the print controller can cause the print assembly, such as print assembly 14, to take corrective action, step 208. Correction action may include, among other options, suspending ongoing print operations, sending a warning message to a user and/or canceling pending print requests.

Thus, the present invention provides apparatus and methods of determining the position of one or more radio frequency signatures on a cut sheet of print media in order to help eliminate or reduce the occurrence of ruined print media. It is contemplated the invention would allow the detection of print media that is improperly oriented or mis-fed. Such conditions have the potential of placing a radio frequency signature closer than or farther away from an edge of the print media as it is fed into the printer.

It should be understood that modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A radio frequency signature position detecting apparatus comprising:

a printer assembly with a print media pathway through which print media is fed;

a radio frequency interrogating device that is angled with respect to the direction of travel of said print media;

a print media sensor;

a print controller that calculates the time differences between when said print media sensor detects a cut sheet of print media as having reached a designated point along said print media pathway and when said radio frequency interrogating device detects a radio frequency signature embedded in said print media;

said print controller using the time differences and the known angle between the radio frequency interrogating device and the print media sensor to calculate the relative left/right position of said radio frequency signature.

2. The apparatus of claim 1 wherein said print media sensor is located at a predetermined position from said radio frequency interrogating device and said position is known by said print controller.

3. The apparatus of claim 1 wherein said print media sensor signals said print controller upon detecting the leading edge of print media.

4. The apparatus of claim 1 wherein said print media sensor signals said print controller upon detecting the trailing edge of print media.

5. The apparatus of claim 1 wherein said radio frequency interrogating device further comprises:

a radio frequency antenna; and a read/write module for detecting the presence of a radio frequency signature via said radio frequency antenna.

6. The apparatus of claim 5 further comprising a print controller in communication with said read/write module for receiving a signal from said read/write module indicative that a radio frequency signature has been detected.

7. The apparatus of claim 5 wherein said radio frequency antenna is shielded so that said read/write module detects the presence of a radio frequency signature when said radio frequency signature is substantially below said radio frequency antenna.

8. The apparatus of claim 5 wherein said radio frequency antenna is positioned about said print media pathway such that a radio frequency signature is detected when print media fed through said print media pathway places said radio frequency signature substantially below said radio frequency antenna.

9. The apparatus of claim 8 wherein said read/write module does not react to radio frequency signatures to the left or right of a radio frequency signature substantially below said radio frequency antenna.

10. The apparatus of claim 1 wherein said radio frequency interrogating device is a RFID reader.

11. The apparatus of claim 10 wherein said radio frequency signature is contained in an RFID tag.

12. A method of detecting the position of a radio frequency signature on print media comprising using a radio frequency interrogating device to determine the relative position of a radio frequency signature traversing on a cut sheet of print media as the print media is fed through a printer's print media pathway;

providing a print controller and calculating the time differences between when a print media sensor detects a cut sheet of print media as having reached a designated point along said print media pathway and when a radio frequency interrogating device detects the presence of two or more radio frequency signatures embedded in the print media; and the print controller using the time differences and the known angle between the radio frequency interrogating device and the print media sensor to calculate the relative left/right positions of each radio frequency signature embedded in the print media.

13. The method of claim 12 further comprising the step of a print media sensor detecting the when said print media reaches a designated point along said print media pathway.

14. The method of claim 12 further comprising the print controller noting the time when the print media sensor detects the print media as having reached a designated point along said print media pathway.

15. The method of claim 14 further comprising the steps of:

the radio frequency interrogating device detecting the presence of a radio frequency signature embedded in print media; and the print controller noting the time when the radio frequency interrogating device detects the presence of a radio frequency signature embedded in the print media.

16. The method of claim 15 further comprising the step of the print controller calculating the time difference between when the print media sensor detects the print media as having reached a designated point along said print media pathway and when the radio frequency interrogating device detects the presence of a radio frequency signature embedded in the print media.

17. The method of claim 16 further comprising the step of the print controller using the time difference and the known angle between the radio frequency interrogating device and the print media sensor to calculate the relative left/right position of the radio frequency signature.

18. The method of claim 12 further comprising the step of the print controller calculating the relative left/right order of each radio frequency signature embedded in the print media.

19. The method of claim 12 further comprising the step of the print controller determining if print media is mis-oriented or mis-fed.

20. The method of claim 19 further comprising the step of the print controller taking corrective action if the print media is mis-oriented or mis-fed.

* * * * *